US006650857B2

(12) United States Patent
Nukada et al.

(10) Patent No.: US 6,650,857 B2
(45) Date of Patent: Nov. 18, 2003

(54) LIQUID ELECTROPHOTOGRAPHIC APPARATUS

(75) Inventors: Hideki Nukada, Kanagawa-ken (JP); Atsuko Iida, Kanagawa-ken (JP); Takashi Sasaki, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/093,415

(22) Filed: Mar. 11, 2002

(65) Prior Publication Data

US 2002/0131794 A1 Sep. 19, 2002

(30) Foreign Application Priority Data

Mar. 15, 2001 (JP) ..... 2001-074539

(51) Int. Cl.[7] ..... G03G 15/10
(52) U.S. Cl. ..... 399/249
(58) Field of Search ..... 399/249, 250, 399/251, 348

(56) References Cited

U.S. PATENT DOCUMENTS 5,221,944 A * 6/1993 Yoda et al.
2002/0028090 A1 * 3/2002 Shin et al.

FOREIGN PATENT DOCUMENTS

JP 10-10874 1/1998

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus as described in the embodiments of the present invention comprises a latent image forming unit for forming an electrostatic latent image on the surface; a developing device which supplies liquid developer containing toner particles and carrier liquid to the electrostatic latent image, and forms a developed image on the latent image forming unit; a transferring device which transfers the developed image on the latent image forming unit onto a recording medium, a conveying path of the developed image being formed from the developing device to the recording medium; and a blowing unit equipped with a guide wall to cover at least a part of the conveying path, the guide wall providing a gap of more than 0.5 mm and less than 5 mm, and an air current generating source which generates an air current in the gap, and thoroughly dries and removes excess carrier liquid by exposing a developed image to the air current for a long time.

18 Claims, 5 Drawing Sheets

(Comparative Example 1)

(Comparative Example 2)

(Comparative Example)

LIQUID ELECTROPHOTOGRAPHIC APPARATUS

CROSS REFERENCE TO RELATED APPLICATIONS

This application is based upon and claims the benefit of priority from the prior Japanese Patent Application No. 2001-74539, filed on Mar. 15, 2001; the entire contents of which are incorporated herein by reference.

BACKGROUND OF THE INVENTION

1. Field of the Invention

The present invention relates to an image forming apparatus which forms developed images using liquid developers containing toner particles and a carrier liquid and more particularly to an image forming apparatus which is capable of removing excess carrier liquid remaining on developed images.

2. Description of the Related Art

An image forming apparatus to get developed image s using liquid developers has such merits that high image quality is realized as extremely fine toner particles in sub micron size are used, it is economical as sufficient image density is provided by small amount of toners and in addition, texture as excellent as printing (for example, offset printing) is obtained and energy saving is achieved as toners can be fixed on paper at relatively low temperatures.

When forming an image by this image forming apparatus using liquid developers, as one method to transfer developed images formed on a photosensitive drum, there is a pressure transfer method which transfers toner particles on the surface of the photosensitive drum to a recording medium utilizing adhesive power of toner particles by bringing the photosensitive drum in contact with the recording medium under pressure.

This pressure transfer method is a method to transfer toner particles on the surface of the photosensitive drum onto a recording medium utilizing adhesive power of toner particles by bringing the photosensitive drum in contact with the recording medium under pressure. In this pressure transfer method, transfer efficiency is lowered if the photosensitive drum surface is wet by carrier liquid at the time of transfer and it is therefore necessary to thoroughly remove excess carrier liquid remaining on a developed image before starting the transfer process in order to improve transfer efficiency.

As a device to remove excess carrier liquid remaining on a developed image prior to the transfer process, a device to dry and remove excess carrier liquid remaining on the photosensitive drum after completing the development using at least more than one blower was so far developed. Further, for removing excess carrier liquid on a developed image prior to the transfer process, a device for absorbing and removing excess carrier liquid remained on a photosensitive drum using an elastic porous roller after completing the development was developed as disclosed in Japanese Patent Publication Numbers 11-249445, 11-249524 and 9-15981.

Further, as a device for removing excess carrier liquid remaining on a developed image prior to the transfer process, a device for absorbing and removing excess carrier liquid remained on a photosensitive drum after completing the development using an elastic roller and then, for further drying and removing excess carrier using a blower was proposed so as to increase excess carrier liquid removing efficiency as disclosed in Japanese Patent Publication No. 58-66953.

However, reduction of a time required for removing excess carrier liquid was increasingly demanded with the progress of the high-speed image forming process in recent years and in the case of such a high-speed image forming apparatus, even when a method for absorbing and removing excess carrier liquid by an elastic porous roller was used jointly with a method for drying and removing excess carrier liquid by a blower as mentioned above, excess carrier liquid could not be removed thoroughly before a developed image reached the transfer position after completing the development and transfer efficiency according to the pressure transfer method might possibly be lowered.

Further, in the case of a transfer device according to the pressure transfer method, with the progress of a high-speed image forming apparatus, pressure force at the transfer position increases. With this increase in pressure force, deterioration of transfer efficiency for residual excess carrier liquid became further remarkable and transfer efficiency was remarkably impeded and display quality might be lowered extremely.

Accordingly, irrespective of the progress of an image forming process, it is desired to realize a practical use of a high-speed image forming apparatus that enables more efficient pressure transfer and improves display quality by thoroughly removing excess carrier liquid prior to the transferring operation.

SUMMARY OF THE INVENTION

An object of the present invention is to provide a high-speed image forming apparatus, which is provided with a blowing unit for removing excess carrier liquid remaining on a photosensitive drum quickly and certainly prior to transferring an image, improves transfer efficiency according to a pressure transfer method and obtains a transferred image of high quality.

According to the embodiments of the present invention, an image forming apparatus comprises: a latent image forming unit for forming an electrostatic latent image on the surface; a developing device which supplies liquid developer containing toner particles and carrier liquid to the electrostatic latent image, and forms a developed image on the latent image forming unit; a transferring device which transfers the developed image on the latent image forming unit onto a recording medium, a conveying path of the developed image being formed from the developing device to the recording medium; and a blowing unit equipped with a guide wall to cover at least a part of the conveying path, the guide wall providing a gap of more than 0.5 mm and less than 5 mm, and an air current generating source which generates an air current in the gap.

Further, according to the embodiments of the present invention, the image forming apparatus comprises: a photosensitive drum for forming an electrostatic latent image on the photosensitive drum surface; a developing device which supplies liquid developer containing toner particles and carrier liquid to the electrostatic latent image, and forms a developed image on the photosensitive drum; a transferring device which transfers the developed image on the photosensitive drum onto a recording medium, a conveying path of the developed image being formed from the developing device to the recording medium; and a nozzle block equipped with a guide wall to cover at least a part of the conveying path, the guide wall providing a gap of more than 0.5 mm and less than 5 mm, and an air current generating source which generates an air current in the gap.

DETAILED DESCRIPTION OF THE INVENTION

Figure 1:
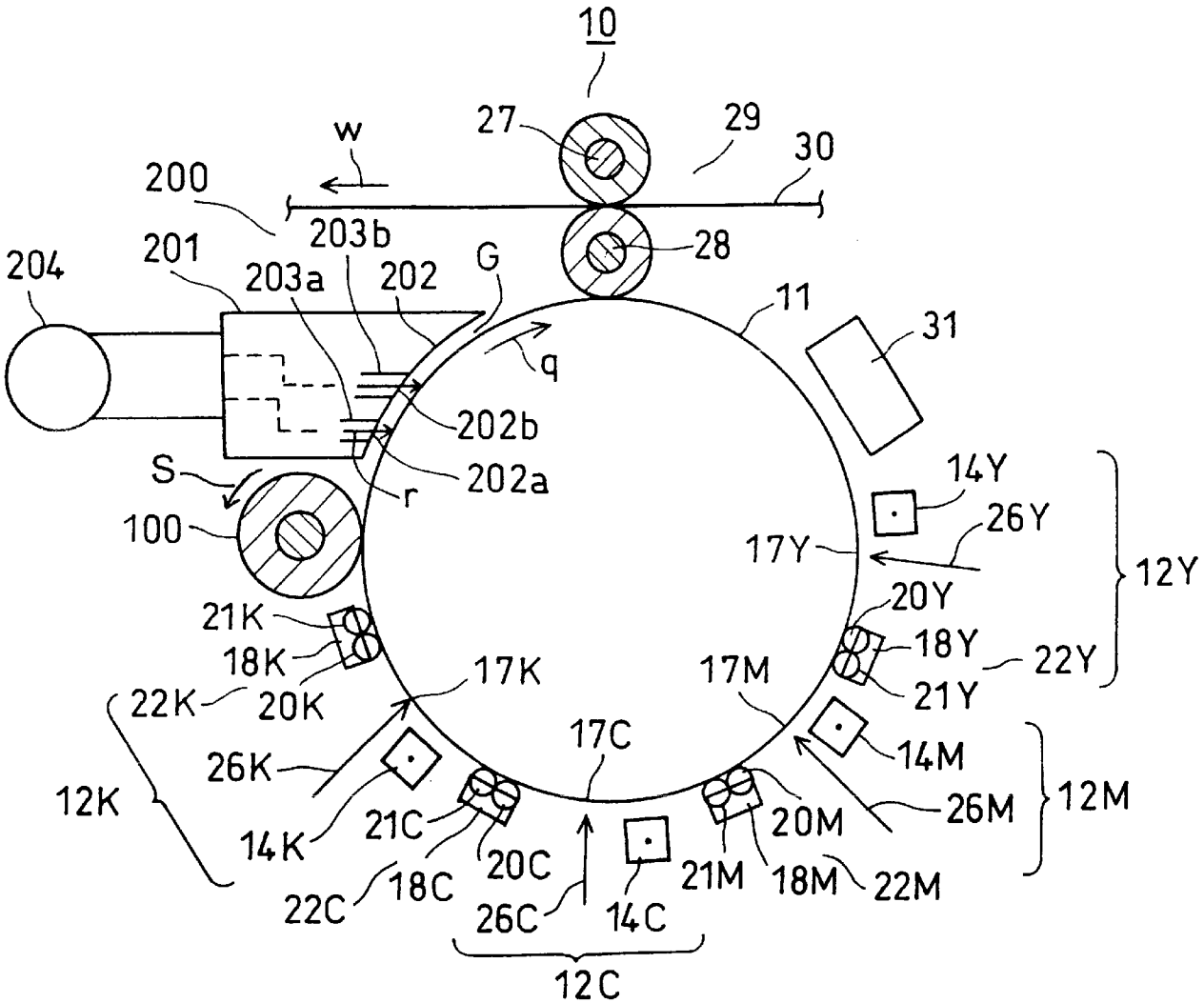
FIG. 1 is a schematic block diagram showing an electrophotographic apparatus in a first embodiment of the present invention.

Preferred embodiments of the present invention will be described below in detail referring to the attached drawings. A first embodiment of the present invention will be first described. FIG. 1 shows an image forming portion of an electro-photographic apparatus 10 that is an image forming apparatus.

Around a photosensitive drum 11 having an organic or an amorphous silicon photosensitive layer formed on a conductive base that is a latent image forming unit made of, for example, aluminum, first through fourth image forming units 12Y~12K are arranged in order. These image forming units 12Y~12K form color images in yellow (Y), magenta (M), cyan (C), and black (K) using respective color liquid developers on the photosensitive drum 11 along an arrow direction "q" that is a rotating direction of the photosensitive drum 11.

The image forming units 12Y~12K are basically in the same structure except that liquid developers in different colors are used. Accordingly, these image forming units 12Y~12K will be explained referring to the yellow (Y) image forming unit 12Y that is arranged at the upper stream, and the same reference numerals are assigned to the same elements with subscripts showing respective colors added, and the explanations thereof will be omitted.

The yellow (Y) image forming unit 12Y comprises a charger 14Y comprising a well-known corona charger or a scorotron charger; an exposing portion 17Y that selectively applies a laser beam 26Y corresponding to yellow (Y) light signal from a laser emitter (not shown); and a developing device 22 that has a development roller 20Y that accommodates yellow (Y) liquid developer 18Y supplied from a developer storage portion (not shown) and is applied with developing voltage, and a defogging roller 21Y.

Here, the liquid developers 18Y~18K have different color toner particles in particle size 0.1~2 $\mu$m and carrier liquid that is for dispersing these toner particles. As the carrier liquid, non-polarized petroleum solvent such as Isopar L (produced by Exxon Corporation) is used.

At the downstream of the image forming units 12Y~12K around the photosensitive drum, an elastic porous roller 100 is provided as an absorbing means for absorbing and removing excess carrier liquid remaining on the photosensitive drum 11 after completing the development. At the downstream of the elastic porous roller 100 around the photosensitive drum 11, a nozzle block 200 is provided as a blowing unit for drying and removing excess carrier fluid remaining on the photosensitive drum 11.

Further, at the downstream of the nozzle block 200 provided around the photosensitive drum 11, there are a transferring device 29 provided for pressure transferring a developed image and a cleaner 31 for removing residual toner particles on the photosensitive drum 11 after completing the developed image transfer.

The transferring device 29 comprises a pressure roller 27 and an intermediate transfer roller 28 that is compressed against the photosensitive drum 11 at the pressing force of about 0.5~50 kgf/cm$^2$ by this pressure roller 28. The transferring device 29 transfers a toner image comprising toner particles formed on the photosensitive drum 11 on the intermediate transfer roller 28 by utilizing the adhesive power of the toner particles and then, transfer the toner image on a paper 30 that is a recording medium.

Thus, developed image formed on the surface of the photosensitive drum 11 by the developing devices 22Y–22M of the image forming units 12Y–12K are formed on the surface of the intermediate transfer roller 28 and then, pressure transferred on a paper 30 by the intermediate transfer roller 28.

Next, the elastic porous roller 100 and the nozzle block 200 for removing excess carrier liquid left on the photosensitive drum 11 will be explained in detail. After completing the development, the elastic porous roller 100 contacts to a developed image on the photosensitive drum 11. The elastic porous roller 100 has a fine elastic porous surface. The porous surface is electrical conductive to prevent the toner particles from adhesion with the roller 100. The elastic porous roller 100 rotates in the direction "s" as indicated by the arrow at the same peripheral velocity as the photosensitive drum 11, and contacts to the photosensitive drum 11.

The smoothness of the elastic porous surface of this elastic porous roller 100 is improved by making its porous diameters extremely fine and thus, preventing adhesion of toner particles and accelerating carrier liquid absorption speed by a capillary phenomenon. Actually, as elastic porous materials, fine porous sheet materials represented by such rubber materials as elastic polyurethane sponge, GORE-TEX (produced by GORE-TEX Corporation), etc. with conductivity given by dispersing fine carbon powder or elastic porous surfaces applied with an extremely thin conductive coating such as polypyrrole are pointed out, and porous hole diameters in 0.2~30 $\mu$m are preferred.

The elastic porous roller 100 may be finished to a mirror surface using an abrasive for further promoting its surface smoothness. The elastic porous roller 100 is applied with bias voltage of which polarity is reverse to toner particles from a power source (not shown) so as to prevent adhesion of toner particles to the elastic porous roller 100 side.

Next, the nozzle block 200 will be explained. A guide wall 202 is formed on the surface of the case 201 of the nozzle block 200 opposite to the photosensitive drum 11 to cover a part of its surface from the elastic porous roller 100 to the intermediate transfer roller 29 via about 2 mm gap G. The surface of this guide wall 202 is formed in an even and smooth shape so as to prevent generation of turbulence in the gap "G".

That is, the guide wall 202 is made of aluminum or stainless steel and its surface is polished with a file of No.

600 or so and is formed in the same coaxial curved shape as the surface of the photosensitive drum 11. The guide wall 202 has two slits 202*a,* 202*b* of which longitudinal directions are orthogonal to the arrow direction "q" that is the rotating direction of the photosensitive drum 11.

Further, the two slits 202*a,* 202*b* are provided with two nozzles 203*a,* 203*b* to which the air current generated by a 750 W fan 204 is supplied through a pipe 204*a*. These two nozzles 203*a,* 203*b* and the fan 204 comprises an air current generating source that generates the air current along the photosensitive drum 11 to the gap G formed between the photosensitive drum 11 and the guide wall 202.

Figure 2:
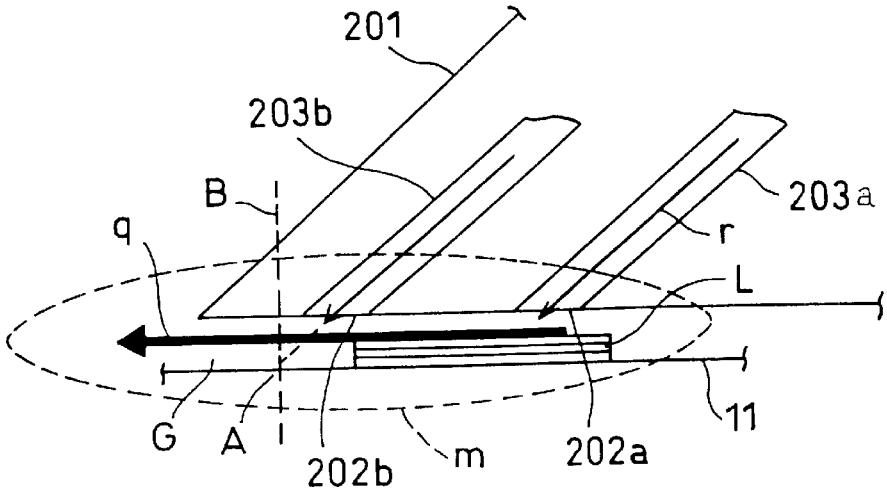
FIG. 2 is a schematic diagram for explaining the dried state of carrier liquid by a nozzle block in the first embodiment of the present invention.

That is, as shown in FIG. 2, the air current flowing in the arrow direction "r" from the nozzles 203*a,* 203*b* is blown against the photosensitive drum 11 from the upper stream side above the normal line B at the position A on the surface of the photosensitive drum 11 where the air current is blown against. Accordingly, the air current flows into the narrow gap G along the surface of the photosensitive drum 11 without being decelerated after blown against the photosensitive drum 11.

At this time, if the process velocity of the electrophotographic apparatus 10 is 220 mm/s, the air current from the nozzles 203*a,* 203*b* flows on the photosensitive drum 11 at a speed as high as about 40~50 m/s in the arrow direction "q" that is the same as the rotating direction of the photosensitive drum 11.

Next, the operation will be described. When the image forming is started, with the rotation in the arrow direction "q", the photosensitive drum 11 is charged by the charger 14Y and then, the laser beam 26Y is selectively applied according to a yellow image information irradiated from a laser emitter (not shown) corresponding to an image information in the image forming unit 12Y, and an electrostatic latent image is formed corresponding to a yellow (Y) image.

Further, toner particles of yellow (Y) liquid developer 18Y supplied to a gap with the development roller 20Y that is arranged in the non-contact state is adsorbed on the photosensitive drum 11 by electrophoretic effect. Then, fog toner particles left on the photosensitive drum 11 are removed by the defogging roller 21Y and a yellow (Y) toner image is formed. Further, carrier liquid in a liquid developer left on the photosensitive drum 11 may be scraped by this defogging roller 21Y to reduce amount of excess carrier liquid in advance at the time of development.

In the same manner, magenta (M), cyan (C) and black (K) toner images are superposed in order by the succeeding image forming units 12M~12K and a full-color developed image is formed.

After the development is completed, when the full-color developed image formed on the photosensitive drum 11 reaches the contact position with the elastic porous roller 100 accompanied with the rotation of the photosensitive drum 11, excess carrier liquid left on the photosensitive drum 11 is first adsorbed on the surface of the elastic porous roller 100 by the capillary phenomenon. As the peripheral velocity of the elastic porous roller 100 is in accord with the peripheral velocity of the photosensitive drum 11, the developed image on the photosensitive drum 11 is not disturbed.

Further, as bias voltage in the polarity reverse to toner particles is being applied to the elastic porous roller 100, toner particles on the photosensitive drum 11 is strongly pressed against the drum surface when passing the contact position. Therefore, a developed image is protected from being deteriorated by preventing toner particles from being separated from the photosensitive drum 11 and at the same time, the clogging of the surface of the elastic porous roller 100 by adsorbed toner particles is prevented.

After absorbing and removing carrier liquid by the elastic porous roller 100, a developed image on the photosensitive drum 11 passes through the gap G formed by the guide wall 202 of the nozzle block 200. The nozzle block 200 blows the air current generated by the fan 204 against the surface of the photosensitive drum 11 through the two slits 202*a,* 202*b* of the two nozzles 203*a,* 203*b*. By this air current from the nozzles 203*a,* 203*b,* an air current at a wind velocity about 40~50 m/s is generated in the gap "G" in the arrow direction "q".

As the surface of the guide wall 202 is formed in an even and smooth shape generating no turbulence in the gap "G", the air current is kept at a high wind velocity in the gap G without reducing it at this time. Accordingly, the air current of wind velocity about 40~50 m/s is continuous flown against a developed image on the photosensitive drum 11 while it is being conveyed in the gap "G", residual excess carrier liquid is thoroughly dried and removed.

Thus, when a developed image with excess carrier liquid removed reaches the transferring device 29, the developed image is pressure transferred on the intermediate transfer roller 28 that is press fitted to the photosensitive drum 11 by a load of a pressure roller 27 by the adhesive power of toner particles, and further transferred from the intermediate transfer roller 28 on a paper 30 that is conveyed in the arrow direction "w" from the intermediate transfer roller 28 and a full-color image is formed on the paper 30.

At the time of this pressure transfer, as excess carrier liquid was thoroughly removed from the photosensitive drum 11, a developed image is transferred on the intermediate transfer roller 28 and further on the paper 30 at a high transfer efficiency without deteriorating the adhesive power of toner particles. Then, after completing the transfer, the photosensitive drum 11 is cleaned by removing residual toner particles by a cleaner 31, and completing a series of image forming processes, becomes ready for the next image forming process.

Further, when a developed image was formed at a process velocity 220 mm/s using the electro-photographic apparatus 10 equipped with the nozzle block 200 in this first embodiment and its transfer test was conducted, excess carrier liquid left on the photosensitive drum 11 was completely removed before arriving at the intermediate transfer roller 28, a high transfer efficiency could be obtained and a high display quality and satisfactory transferred image was obtained.

Figure 3:
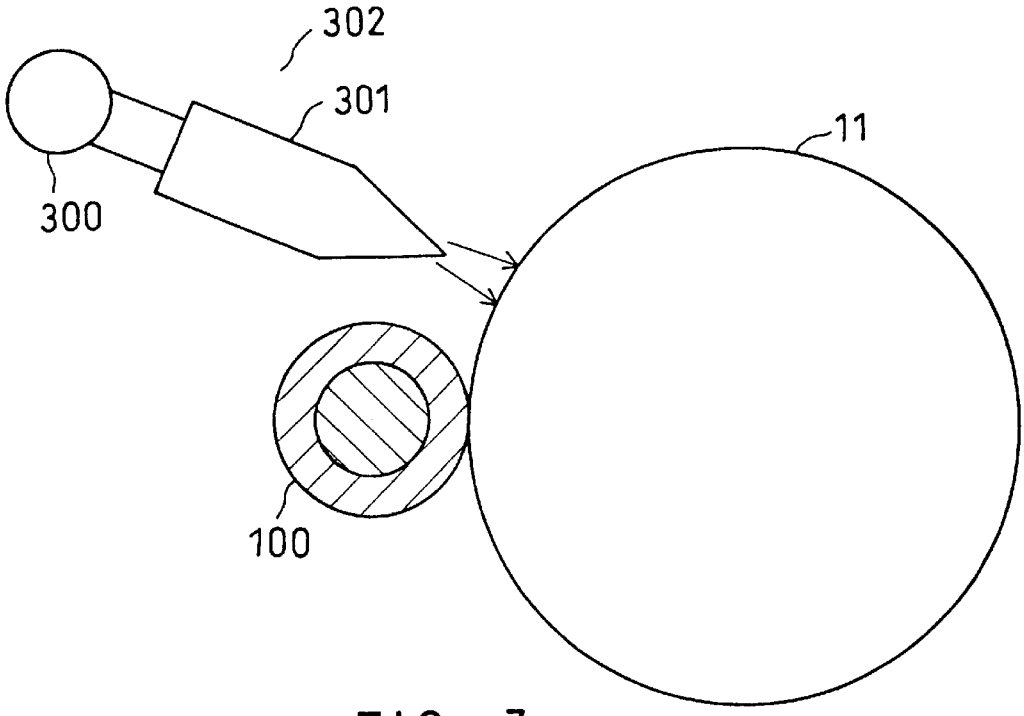
FIG. 3 is a schematic block diagram showing comparative Example 1.

Contrary to the above, as (Comparative Example 1), a transfer test was conducted with the electro-photographic apparatus 10, using a drying device 302 provided which blows the air current from the conventional drying nozzle 301 by a 750 W fan 300, instead of the nozzle block 200, as shown in FIG. 3. Carrier liquid couldn't be removed by one time of blowing, and at least 6 times of the blowing operation (6 rotations of the photosensitive drum 11) were needed to thoroughly remove carrier liquid.

Figure 4:
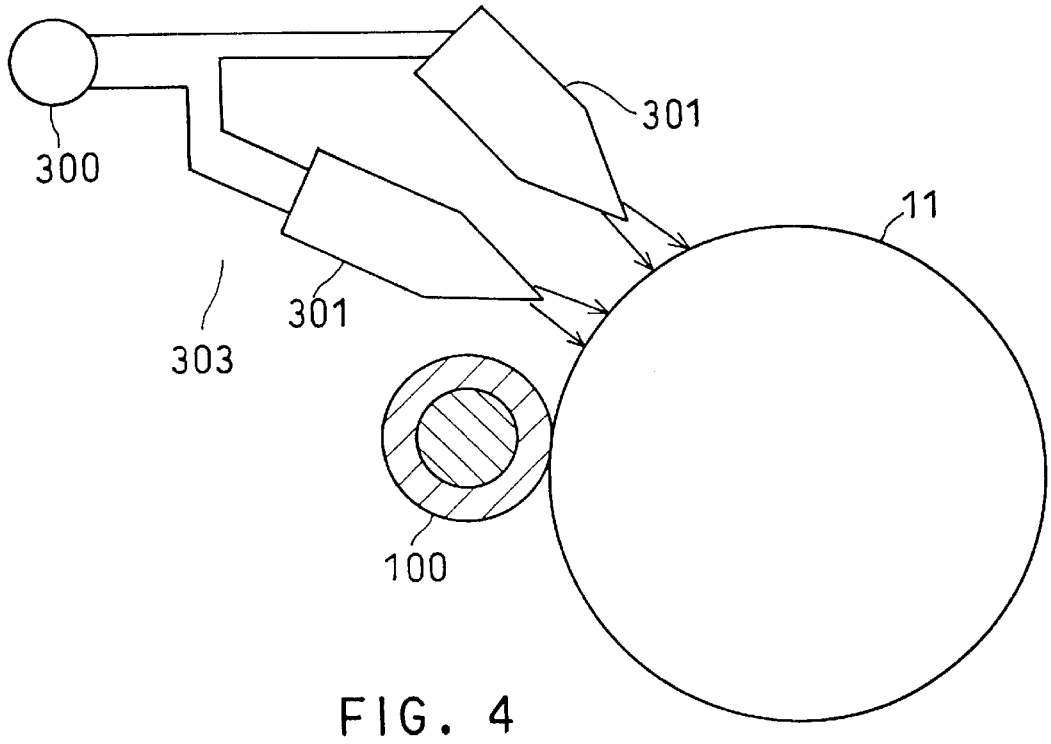
FIG. 4 is a schematic block diagram showing comparative Example 2.

Similarly, as (Comparative Example 2), when a transfer test was conducted by the electro-photographic apparatus 10 using a 750 W fan 300 instead of the nozzle block 200 with a drying device 303 provided to blow the air current from two conventional drying nozzles 301 as shown in FIG. 4, carrier liquid couldn't be removed by one time of blowing but at least 4 times of the blowing operations (4 rotations of the photosensitive drum 11) were needed to thoroughly remove carrier liquid.

In the nozzle block 200 in the first embodiment, as shown by the dotted line "m" in FIG. 2, a developed image "L" is exposed to the air current at a high velocity in the arrow direction "q" for a long time while conveying the gap "G" formed by the guide wall 202, and the drying area extends over a wide range and carrier liquid is efficiently dried and removed.

Figure 5:
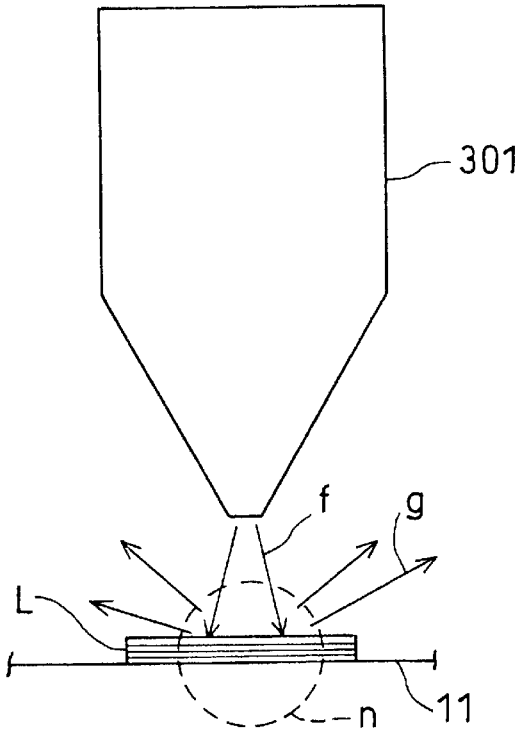
FIG. 5 is a schematic diagram showing the dried state of carrier liquid by a drying nozzle in the comparative Example.

Contrary to this, in the conventional drying nozzle 301 shown in the comparative example, as shown by the dotted line "n" in FIG. 5, the air current in the arrow direction "f" blown from the drying nozzle 301 is quickly dispersed in the environment and attenuated as shown by the arrow mark "g" after blown against the photosensitive drum 11 in a spot shape or a slit shape. Therefore, the drying area actually participated in the drying and removing of carrier liquid is extremely narrow and drying efficiency is extremely low.

When the image forming apparatus is constructed as shown in the first embodiment, even when the speed of the image forming process of the electro-photographic apparatus 10 is fast, excess carrier liquid left on the photosensitive drum 11 is exposed in the wide range drying area for a long time while passing the gap "G" to the nozzle block 200 after adsorbing and removing by the elastic porous roller 100 and thoroughly dried and removed by the air current flowing in the gap "G" at a high speed.

Accordingly, when transferring a developed image under pressure in the electro-photographic apparatus 10 of which image forming processing speed is fast, the improper transfer for improper removal of excess carrier liquid can be prevented, a transferred image of high quality at high transfer efficiency is obtained, and the realization of a high speed image forming apparatus can be achieved.

Furthermore, since the guide wall 202 of the nozzle block 200 in this embodiment is formed smoothly, the air current will not be decelerated in the gap "G" by the turbulence.

Further, as the air blows from the nozzles 203*a,* 203*b* in the same direction as the rotating direction of the photosensitive drum 11, resistance by the photosensitive drum 11 is less, high velocity of the air current can be maintained satisfactorily and carrier liquid can be removed more satisfactorily.

Figure 6:
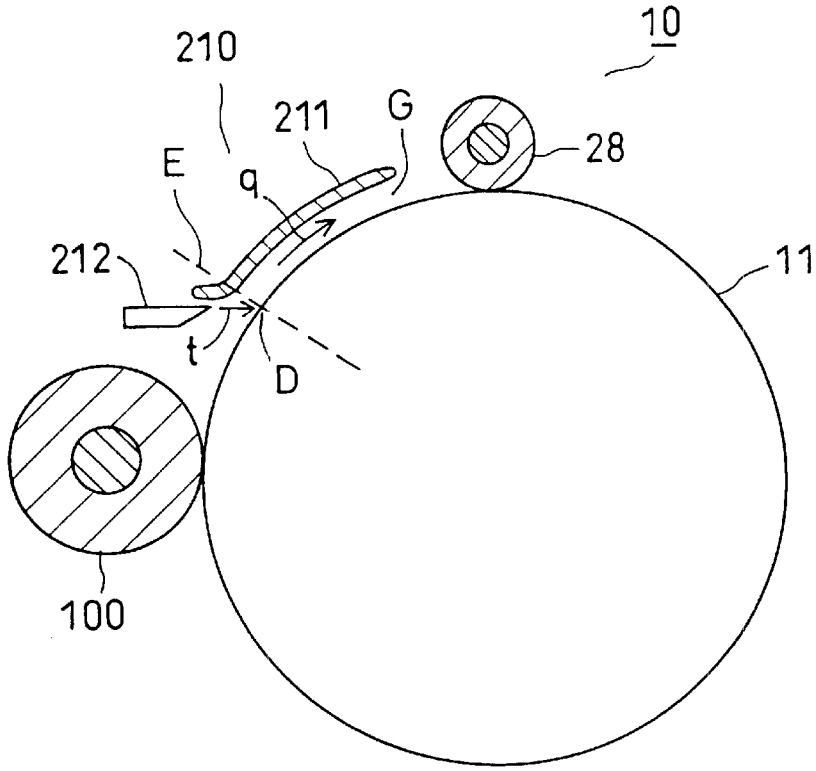
FIG. 6 is a schematic structural diagram showing the electro-photographic apparatus in a second embodiment of the present invention.

Next, a second embodiment of the present invention will be explained referring to FIG. 6. In this second embodiment, the blowing unit to make carrier liquid dry and remove in the first embodiment as described above is formed by a guide plate and a nozzle provided adjacent thereto and all other elements are the same as the above-mentioned first embodiment. So, the same component elements as those explained in the first embodiment will be assigned with the same reference numerals and the detailed explanation will be omitted.

A drying unit 210 that is a blowing unit in this second embodiment has a guide plate 211 that is a guide wall made of aluminum or stainless steel to cover the surface of the photosensitive drum 11 via a gap "G" in about 2 mm wide after passing the elastic porous roller 100, carrier liquid reaches the intermediate transfer roller 28. The surface of this guide plate 211 is formed in the even smooth so as to prevent generation of the turbulent air in the gap "G", and the surface of the guide plate curved nearly coaxial to the surface of the photosensitive drum 11.

At the upper stream of the guide plate 211 in the rotating direction of the photosensitive drum 11, a nozzle 212 is provided adjacent to the guide plate 211 to blow the air current generated from a 750 W fan (not shown) into the gap "G". The air current in the arrow direction "t" from the nozzle 212 is blown from the upper stream above the normal line "E" at a position "D" to which the air current on the surface of the photosensitive drum 11 is blown.

Thus, when the processing velocity of the electro-photographic apparatus 10 is 220 mm/s, the air current at a wind velocity as high as 40~50 m/s flows through the gap "G" along the surface of the photosensitive drum 11 in the arrow direction "q" that is the same as the rotating direction of the photosensitive drum 11.

During the image forming process, excess carrier liquid on the photosensitive drum 11 is absorbed and removed by the elastic porous roller 100 and then, is exposed to the air current of high velocity generated in the gap "G" and flowing in the arrow direction "q" for a long time when passing the gap "G" that is formed between the photosensitive drum 11 and the guide plate 211 of the drying unit 210, and thoroughly dried and removed.

In this construction, likewise the first embodiment, even when the image forming process speed is fast, excess carrier liquid is thoroughly dried and removed by the air current flowing through the gap "G" at a high speed. Accordingly, when transferring an image under pressure, the improper transfer for the improper removal of excess carrier liquid can be prevented, a transferred image of high quality by a high transfer efficiency is obtained and the realization of a high speed image forming apparatus can be achieved.

Further, as the surface of the guide plate 211 is formed smoothly, the air current will not be decelerated in the gap "G" by the turbulence. Further, as the air blows from the nozzles 212 in the same direction as the rotating direction of the photosensitive drum 11, resistance by the photosensitive drum 11 is less, and high velocity of the air current can be maintained satisfactorily.

Figure 7:
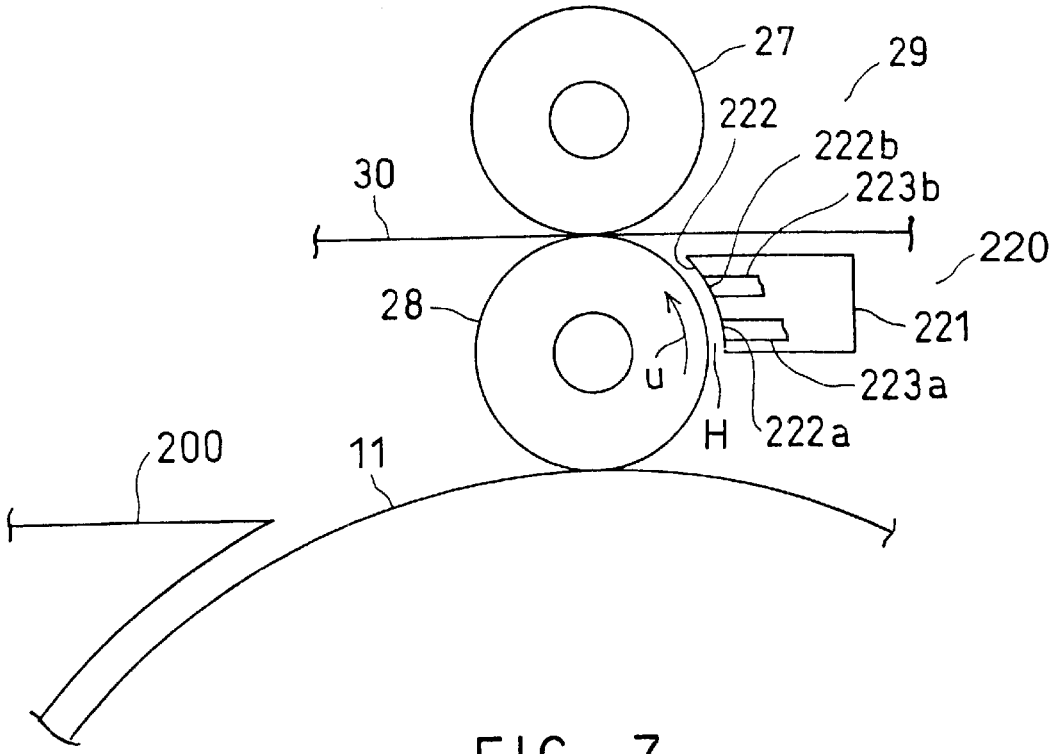
FIG. 7 is a schematic structural diagram showing the electro-photographic apparatus in a third embodiment of the present invention.

Next, a third embodiment of the present invention will be explained referring to FIG. 7. In this third embodiment, excess carrier liquid remained on a developed image transferred on the intermediate transfer roller in the first embodiment is further removed using a nozzle block and other elements are the same as those in the first embodiment and therefore, the same reference numerals are assigned to the same component elements and the detailed explanation will be omitted here.

In this third embodiment, in addition to the nozzle block 200 for drying and removing excess carrier liquid on the photosensitive drum 11, a second nozzle block 220 that is a blowing unit for drying and removing excess carrier liquid on a developed image formed on the surface of the intermediate transfer roller 28 is provided opposing to the intermediate transfer roller 28. On the surface of a housing 221 of the second nozzle block 220 opposite to the intermediate transfer roller 28, a guide wall 222 is formed.

This guide wall 222 is made of aluminum (Al) or stainless steel, etc. and is formed in the even, smooth and nearly coaxial shape to the surface of the intermediate transfer roller 28. This guide wall 222 covers the surface of the intermediate transfer roller 28 via an about 2 mm gap "H" from the intermediate transfer position where the intermediate transfer roller 28 contacts the photosensitive drum 11 to a transfer position where it contacts a paper 30.

The air current generated from a fan (not shown) is flown against the intermediate transfer roller 28 from the tips of the nozzles 223*a,* 223*b* through two slits 222*a,* 222*b* that are formed on the guide wall 222, and the high speed air current flows along the surface of the intermediate transfer roller 28 in the gap "H" in the same arrow direction "u" as the rotating direction of the intermediate transfer roller 28.

Thus, in the image forming process, a developed image on the intermediate transfer roller 28 transferred from the photosensitive drum 11 is exposed to the high speed air current generated in the gap "H" while being conveyed through the gap "H" following the rotation of the intermediate transfer roller 28 and adhered carrier liquid is dries and removed.

When constructed as described above, in addition to the same effect as in the first embodiment, as the carrier liquid adhered to the intermediate transfer roller 28 is further efficiently removed by the second nozzle block 220, transfer efficiency when transferring a developed image on a paper 30 under pressure from the intermediate transfer roller 28 can be further improved, an transferred image can be prevented from being contaminated by carrier liquid adhered to the paper 30, and a transferred image of further high quality can be obtained.

Further, the present invention is not limited to the embodiments described above but can be modified without departing from the spirit and scope thereof. For example, the latent image forming unit can be a photosensitive belt that has a photosensitive layer formed on a rotating ring shaped elastic belt surface, and a transferring device can transfer a developed image directly on a paper from the photosensitive drum not through the intermediate transfer roller.

Further, the pressing force of the transferring device is not limited and further, the transferring device may be applied with heat as necessary when transferring a developed image under pressure. In addition, the number of developing devices, colors of liquid developers, etc. are also optional.

Furthermore, in the image forming process of the image forming apparatus, excess carrier liquid can be dried and removed using a blowing unit whenever a developing process for each developer is completed.

Further, a space of the gap formed between the guide wall and the developed image conveying path is not limited provided that the air current in the gap is maintained at a high speed. However, in order to make the air current high speed, it is preferred to make the space of the gap as narrow as 0.5~5 mm. Further, to create the air current in the gap formed between the guide wall and the conveying path of the developed image, it is necessary that at least one end of the gap is kept open.

Figure 8:
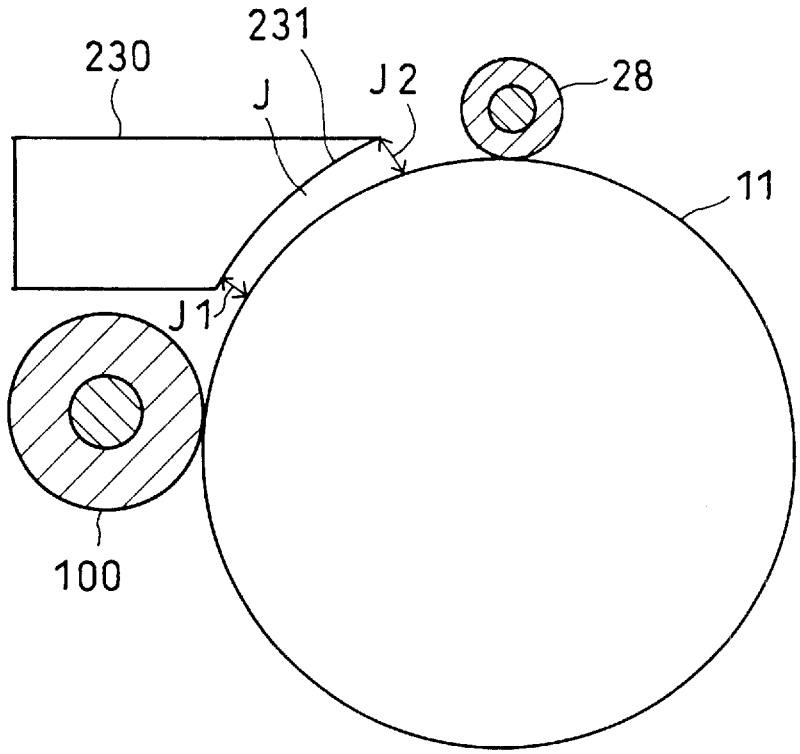
FIG. 8 is a schematic structure diagram showing a nozzle block in a first deformed example of the present invention.

Further, the shape of the gap formed by the guide wall is not necessarily uniform for the overall length. For example, like a first deformed example shown in FIG. 8, the gap width between a guide wall 231 of a nozzle block 230 opposing to the photosensitive drum 11 and the photosensitive drum 11 may be formed gently tilting so that a downstream gap width "J2" becomes wider than an upper stream gap width "J1" in the arrow direction "q" of the photosensitive drum 11. In this construction, the turbulence generated at the exit of the gap "J" can be reduced and decrease in the air current velocity in the gap "J" can be prevented.

Figure 9:
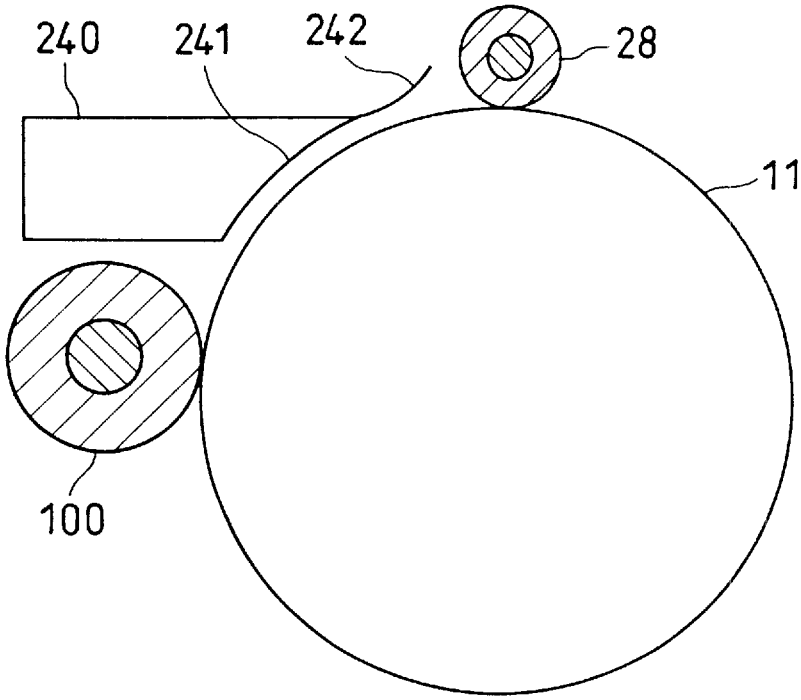
FIG. 9 is a schematic structural diagram showing a nozzle block in a second deformed example of the present invention.

Further, to decrease the turbulent air generated at the exit of the gap and prevent decrease in the air current velocity in the gap, a blade 242 that is so formed that its tip is gently widened is provided at the exit of the gap between a guide wall 241 of a nozzle block opposing to the photosensitive drum 11 as shown in a second deformed example shown in FIG. 9.

Further, in order to maintain high velocity of the air current in the gap by the blowing unit, a flange may be provided at both sides of the photosensitive drum so that the air current does not leak from both sides in the longitudinal direction of the photosensitive drum. Further, a size of electric power to drive a fan for generating the air current in the blowing unit is also optional. In addition, for example, in the first embodiment, the number of nozzles provided to a nozzle block is not limited to two nozzles but may be increased or a single nozzle is enough if the high speed air current can be generated in the gap.

What is claimed is:

1. An image forming apparatus comprising:

a latent image forming unit configured to have an electrostatic latent image, and a developed image formed on the latent image forming unit;

a developing device which supplies liquid developer containing toner particles and carrier liquid to the electrostatic latent image, to form the developed image on the latent image forming unit;

a transferring device which transfers the developed image on the latent image forming unit onto a recording medium, a conveying path of the developed image being formed from the developing device to the recording medium; and a blowing unit equipped with a guide wall to cover at least a part of the conveying path, the guide wall providing a gap of more than 0.5 mm and less than 5 mm, the guide wall having a slit which is square with a conveying direction of the developed image, and an air current generating source connected to the slit, wherein the air current generating source is configured to generate an air current in the gap.

2. An image forming apparatus according to claim 1, wherein the guide wall has plural slits.

3. An image forming apparatus according to claim 1, wherein the transferring device is provided with an intermediate transfer roller which is adjacent to the latent image forming unit, and the guide wall covers the conveying path on the surface of the intermediate transfer roller.

4. An image forming apparatus according to claim 3, wherein the guide wall is in a shape along the surface shape of the intermediate transfer roller, the gap being provided between the guide wall and the intermediate transfer roller.

5. An image forming apparatus according to claim 1 wherein direction of the air current is the same as a conveying direction of the developed image.

6. An image forming apparatus according to claim 1, wherein the guide wall has one end extending to a downstream of a conveying direction of the developed image, the gap being provided between the one end and the latent image forming unit.

7. An image forming apparatus according to claim 1, wherein the guide wall covers the conveying path on the surface of the latent image forming unit and the guide wall is in a shape along a surface shape of the latent image forming unit, a gap being provided between the guide wall and the latent image forming unit.

8. An image forming apparatus comprising:

a photosensitive drum configured to form an electrostatic latent image on the photosensitive drum surface;

a developing device, which supplies liquid developer containing toner particles and carrier liquid to the electrostatic latent image to form a developed image on the photosensitive drum;

a transferring device which transfers the developed image on the photosensitive drum onto a recording medium, a conveying path of the developed image being formed from the developing device to the recording medium; and a nozzle block equipped with a guide wall to cover at least a part of the conveying path, the guide wall providing a gap of more than 0.5 mm and less than 5 mm and having a slit that is orthogonal to a conveying direction of the developed image, and an air current generating source connected to the slit, wherein the air current generating source is configured to generate an air current in the gap.

9. An image forming apparatus according to claim 8, wherein the air current generating source provides with the nozzle that is provided at the slit and blow air against the photosensitive drum, and a fan to feed air to the nozzle.

10. An image forming apparatus according to claim 8, wherein the guide wall has plural slits.

11. An image forming apparatus according to claim 10, wherein the air current generating source has plural nozzles that are provided to respective plural slits for blowing air against the photosensitive drum, and a fan to feed air to the plural nozzles.

12. An image forming apparatus according to claim 8, wherein an air current generating direction by the air current generating source is the same as the rotary direction of the photosensitive drum.

13. An image forming apparatus according to claim 8, wherein the guide wall has one end extending to a downstream of a conveying direction of the developed image, the gap being provided between the one end and the conveying path of the developed image.

14. An image forming apparatus according to claim 8, wherein the guide wall is in a shape along a surface shape of the photosensitive drum, the gap being provided between the guide wall and the photosensitive drum.

15. An image forming apparatus according to claim 14, wherein the guide wall covers the photosensitive drum, the gap being provided between the guide wall and the photosensitive drum, and the gap spreads toward to the downstream of a rotary direction of the photosensitive drum.

16. An image forming apparatus according to claim 14, wherein the guide wall has a blade at the downstream end in the rotary direction of the photosensitive drum, the blade is in a shape to gently separate from the photosensitive drum.

17. An image forming apparatus according to claim 8, wherein an elastic porous roller contacting the developed image is further provided on the conveying path from the developing device to the guide wall.

18. An image forming apparatus according to claim 8, wherein the guide wall is formed with a guide plate, having one extending to a downstream of conveying direction of the developed image, the gap being provided between the one end and the photosensitive drum, and the air current generating source comprises a nozzle configured to blow the air current against the gap from the end of the guide plate at the upper stream of the conveying direction of the developed image, and a fan for feeding air to the nozzle.

* * * * *